United States Patent [19]

Beinhaur et al.

[11] 4,431,198

[45] Feb. 14, 1984

[54] DEVICE FOR CONDUIT SEAL AND REPAIR

[75] Inventors: Ernest L. Beinhaur, Harrisburg; Marshall S. Mountz, Hummelstown, both of Pa.

[73] Assignee: AMP Incorporated, Harrisburg, Pa.

[21] Appl. No.: 439,518

[22] Filed: Nov. 5, 1982

[51] Int. Cl.[3] ..... E04F 17/08; F04B 5/48

[52] U.S. Cl. ..... 277/1; 52/221; 174/65 R; 285/192; 285/297

[58] Field of Search ..... 285/294, 297, 196, 192; 52/221; 277/1, 9, 9.5; 174/65 R

[56] References Cited

U.S. PATENT DOCUMENTS

| | | | |
|---|---|---|---|
| 2,908,744 | 10/1959 | Bollmeier | 285/297 |
| 4,086,736 | 5/1978 | Landrigan | 285/192 |
| 4,153,656 | 5/1979 | Bunyan | 277/1 |
| 4,237,667 | 12/1980 | Pallucci et al. | 52/221 |
| 4,256,920 | 3/1981 | Ayres et al. | 174/65 R |
| 4,262,166 | 4/1981 | Radzishevsky et al. | 174/65 R |
| 4,304,079 | 12/1981 | Thorsten | 52/221 |

*Primary Examiner*—Robert I. Smith
*Attorney, Agent, or Firm*—Donald M. Boles

[57] ABSTRACT

A device for conduit sealing and repair is taught. Briefly stated, a cable or conduit is passed through an opening in a foundation or bulk head enclosure. A substantially cylindrical collar which is longitudinally split into two portions is placed onto the conduit with the conduit and collars then placed into the enclosure opening. An expandable foam is injected into an opening in the collar which, when expanded forces apart the two portions thereby snuggly fitting the collar into the opening. The foam is also allowed to exit through openings in the collar and thereby fills any voids between the exterior of the collar and the interior portion of the opening and which thereby forms a water tight as well as gas tight seal. Reentry into the opening for removal and/or replacement of the conduit is accomplished by pulling on stainless steel strap which are positioned in openings and around portions of the collar. Therefore the removal of the collar as well as the foam which is inside and outside of the collar is easily accomplished.

22 Claims, 5 Drawing Figures

DEVICE FOR CONDUIT SEAL AND REPAIR

This invention relates, generally, to a conduit seal and more particularly to a device for positioning and sealing a conduit or cable passing through an underground foundation.

Conduit, cable, and pipes in the utility field are increasingly being buried undrground so as to provide protection for associated equipment and to eliminate replacement costs of existing equipment above ground. This movement to bury is precipitated by economics in that the cost to bury as opposed to the cost of above ground maintenance provides very clear cut incentives. However, the effective sealing and/or insulation of underground conduit, cable, or piping wherein such devices pass through foundations and/or buried walls has been a continuing problem. Many methods have been tried with the purpose of sealing out water where such devices pass from the outside world into a structure through the foundation. Additionally, many present devices also try to provide a somewhat gas tight seal such as in telephone cable vault rooms wherein slight overpressure is maintained in the vault so as to keep out water, moisture, contaminants, and/or gases. Such present methods in practice utilize rags or expandable foams for the simple usage of packing materials. Additionally, abrasion may result at the entrance point through a foundation or retaining wall.

The assembly of the present invention solves these and other problems by incorporating a collar configuration to surround the conduit, cable, or pipe and enables an expandable foam placed therein to predictably and completely seal an opening.

Accordingly, the present invention teaches a device for sealing and reentering conduit which is passing through an opening in a bulkhead, comprising a bulkhead having at least one aperture therein, conduit passing through the aperture in the bulkhead, conduit sealing device disposed at a point wherein the conduit passes through the bulkhead aperture, the conduit sealing device being comprised of a first and a second collar member, each member substantially the mirror image of the other and surrounding the conduit device, the collar members of sufficient dimension so as to form a cavity therein, the collar device further having conduit sizing rings disposd at each end of the collars for permitting the passsage of conduit therethrough, an expandable foam entry opening contained in either the first or second collar member for permitting the introduction of an expandable foam into the cavity, an expandably expandable foam introduceable into the foam entry opening in the cavity, the foam when expanded filling substantially all the voids contained in the cavity thereby urging one or both of the collar members in substantially diametrically opposite directions, the foam means further exiting through that junction wherein the first and second collar members meet and substantially expanding and filling all voids between the exterior of the conduit sealing device and the bulkhead opening and a cutting cable device passing through at least two apertures in one of the collar members for slicingly slicing through the foam and the collar member upon pulling of the cutting cable device thereby removing at least a portion of the foam and associated collar member so as to allow access to the conduit.

BRIEF DESCRIPTION OF THE DRAWINGS

Reference is now made to the description of the preferred embodiment illustrated in the accompanying drawings in which.

DESCRIPTION OF THE PREFERRED EMBODIMENT

Figure 1:
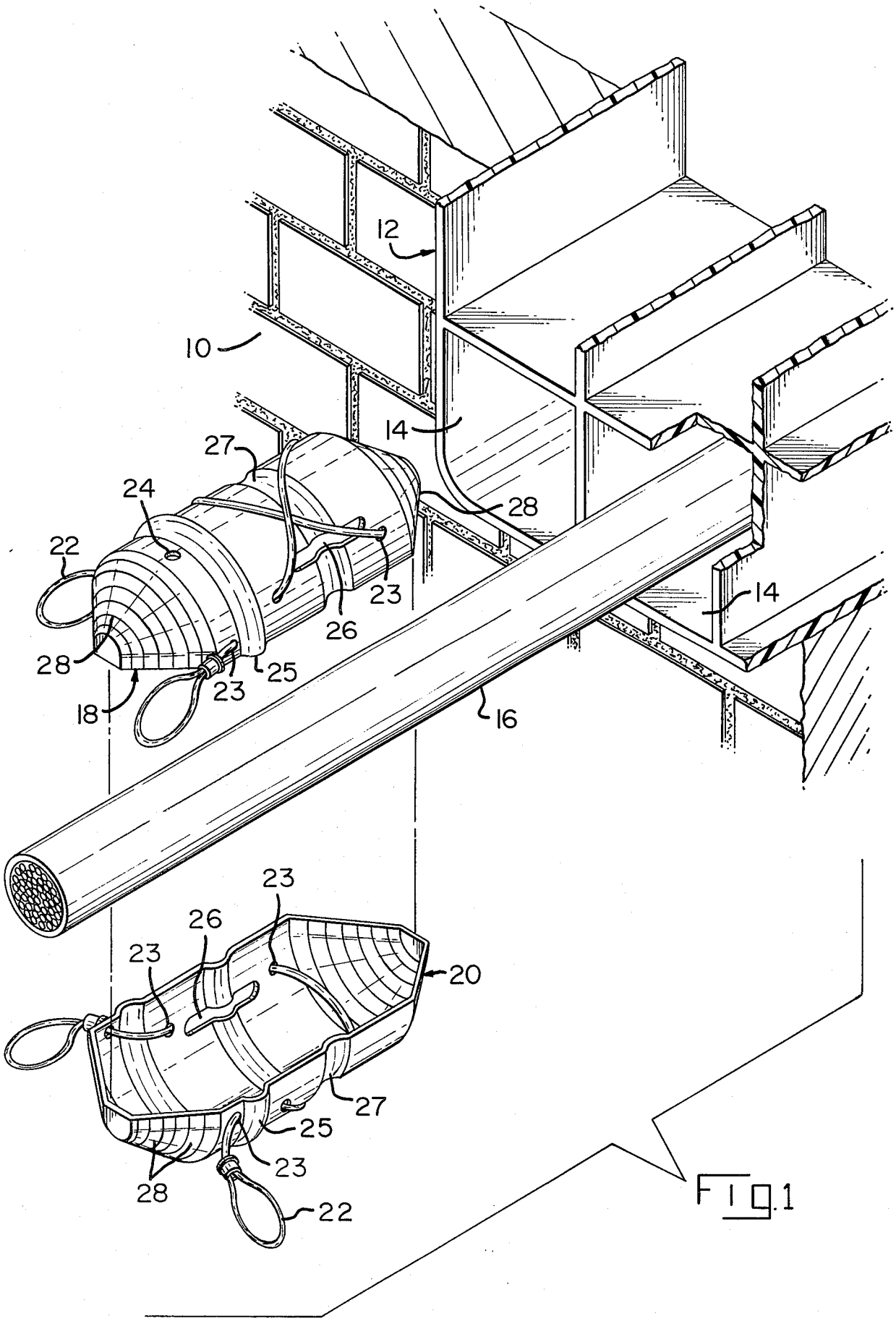
FIG. 1 is an exploded isometric view of the assembly of the present invention.

Referring now to FIG. 1 there is shown an isometric, exploded view of the present invention. A bulkhead 10 is shown which may be part of the foundation of a building structure or a retaining wall or an enclosure such as in an underground vault and is generally comprised of concrete although any other suitable material such as steel may be utilized. Contained in an opening in the bulkhead 10 is a bulkhead entry enclosure 12 having an opening therein 14. The number of openings 14 may vary with the size of the bulkhead entry enclosure 12 and generally forms a honey comb or pigeon hole type of structure, although it is to be understood that as few as one opening may be utilized. Passing through the opening 14 is a cable 16 and which, in the preferred embodiment of the present invention, is a telephone cable, but may be an electrical cable, or gas pipe. Positioned for use with the cable 16 is a split collar first portion 18 and a split collar second portion 20. The split collars 18, 20 in the preferred embodiment of the present invention are formed from plastic although that it is to be understood that any other suitable material can and may be used. Cutting wire 22 which in the preferred embodiment of the present invention is stainles steel, is passed through cutting wire openings contained in the first or second portion 18, 20 and in a criss-cross fashion on the outside of the first and second collar 18, 20. A foam entry opening 24 is disposed in the first portion 18 which allows for insertion of an expandable foam (shown more clearly in FIG. 3). A collar stop 25 is an integral part of the first and second portions 18, 20 and which is used for positioning of the collar 18, 20 in the opening 14 (shown more clearly in FIGS. 3, 4 and 5). A foam exit slit 26 and a flow rib 27 are used to allow for exiting of an expandable foam from the collars 18, 20 and to evenly distribute the foam (shown more clearly in FIGS. 4 and 5). Sizing rings 28 are utilized and allow for breaking and/or cutting away of discrete incremental amounts of the first or second portions of the split collar 18, 20 and are used to accommodate different sizes of cable 16 (shown more clearly in FIG. 2).

Figure 2:
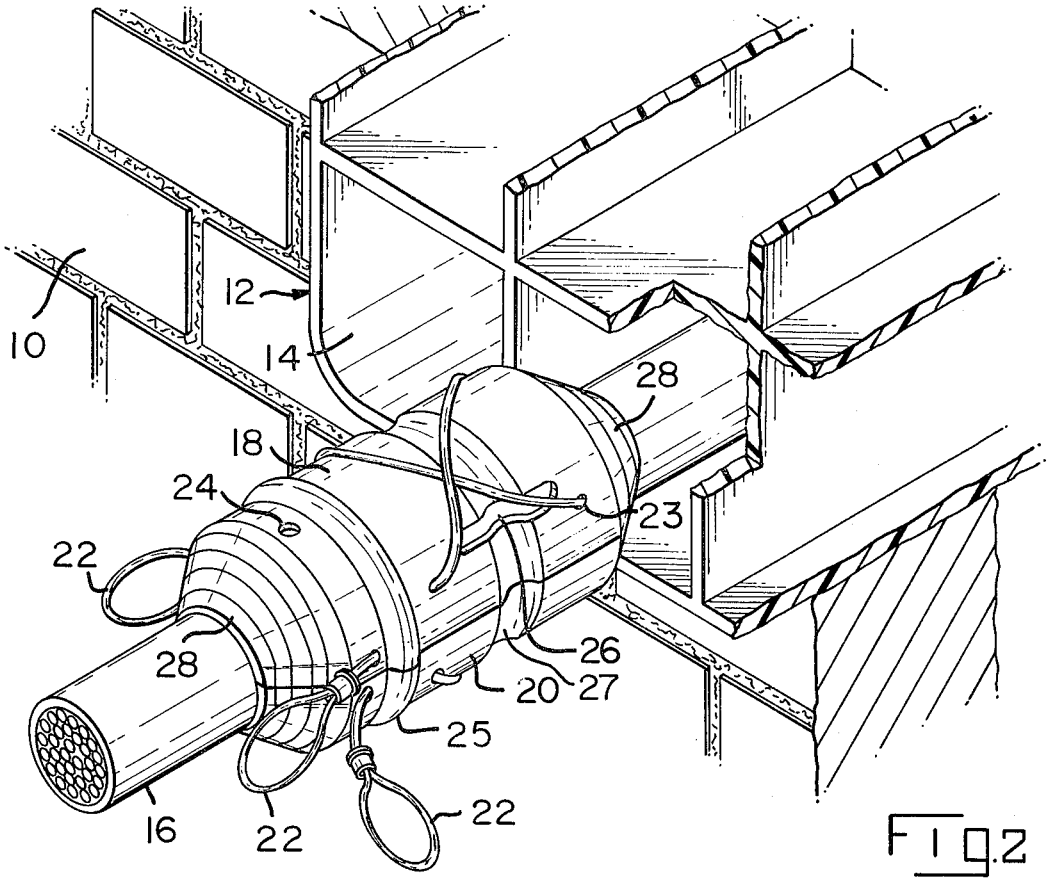
FIG. 2 is an isometric view of the present invention in conjunction with the cable and bulkhead apertures.

Referring now to FIG. 2, there is shown a view of the split collar 18, 20 surrounding the cable 16. Here it can be more clearly seen that a portion of the sizing rings 28 have been removed so as to allow the collar 18, 20 to more closely fit around the cable 16. Additionally evident is that the split collar second portion 20 is slightly smaller in diameter than the split collar first portion 18 thereby allowing a mating of the two collars. It is to be understood, however, that the split collar first portion 18 may be smaller than the split collar second portion 18 or that any suitable means for meeting of the first portion to the second portion 18, 20 may be utilized.

Figure 3:
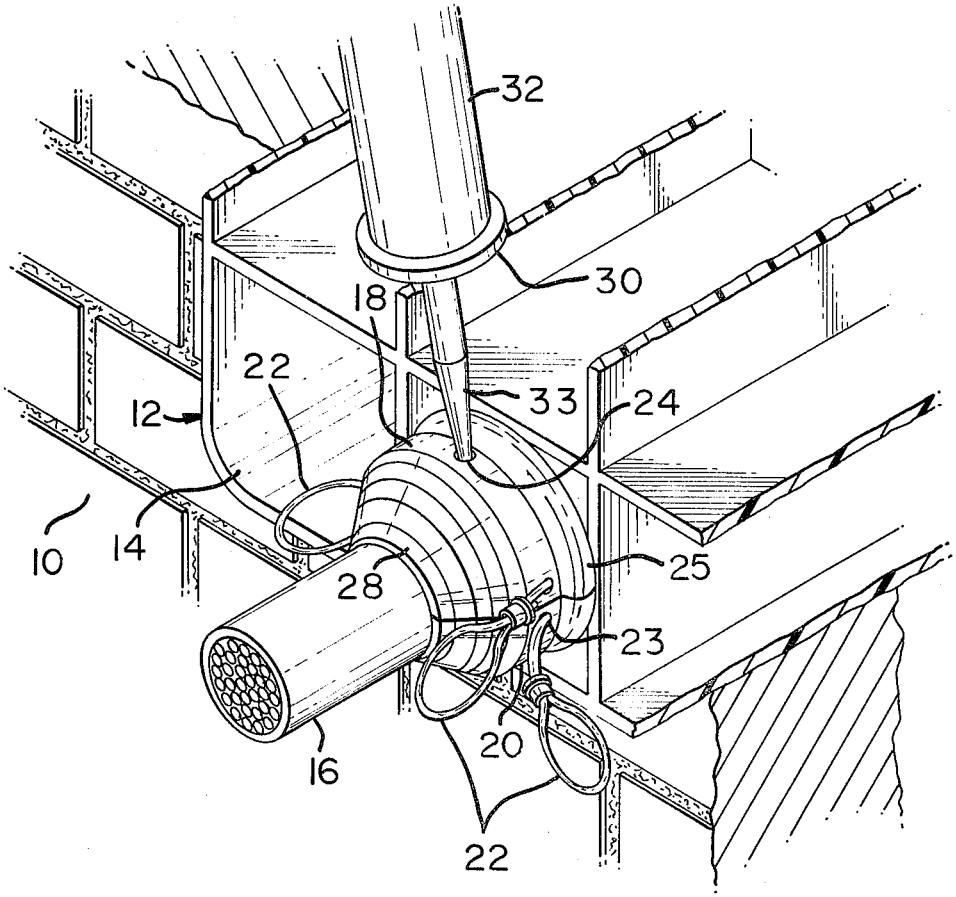
FIG. 3 is an isometric view of an expandable foam sealant being used with the present invention.
Figure 4:
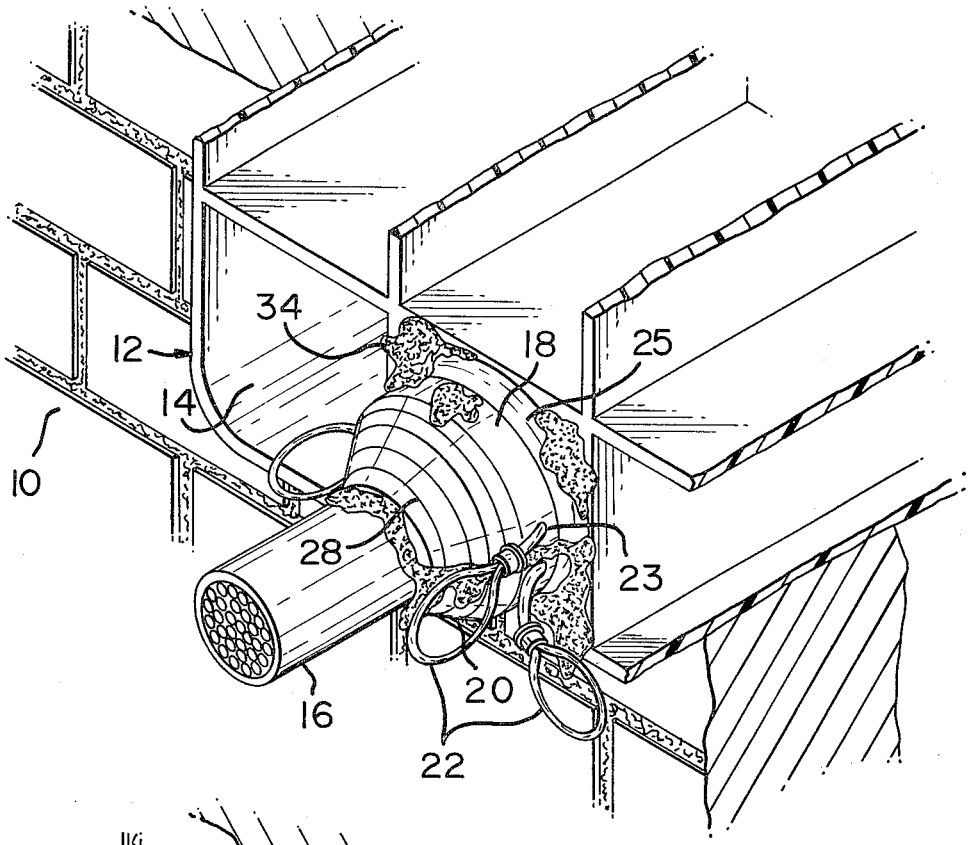
FIG. 4 is an isometric view of the present invention having expanded foam therein and sealably sealing the opening.

Referring now to FIGS. 3 and 4, the installation of the present invention may be seen. Once the first and second portion of the split collar 18, 20 are placed onto the cable 16, the split collars 18, 20 or the cable 16 having the split collars 18, 20 contained thereon is pushed back into the opening 14. The collar stop 25 is provided so as to prohibit from the collars 18, 20 from being inserted too far or not enough into the opening 14. A syringe 30 having non-activated expandable foam 32 contained therein having a nozzle 33 is placed into the foam entry opening 24. The non-activated expandable foam 32 is then inserted into the opening 24 and into the area defined by the split collars 18, 20. The non-activated expandable foam 32, which in the preferred embodiment of the present invention is polyurethane, then goes through a curing process and becomes an expanded foam 34. During expansion of the foam 34, it is allowed to exit through the foam exit slit 26 and follows the flow rib 27 (FIGS. 1 and 2). This, therefore, allows the foam to completely fill the gaps and openings between the outside portion of the split collars 18, 20 and the opening 14. Additionally, the expansion of the foam forces the first and second portions 18, 20 to separate from each other thereby allowing the first and second portions 18, 20 to more snuggly fit in the opening 14 as well as allowing the foam 34 to harden at the point where the collars 18, 20 meet each other as well as the cable 16. This therefore provides a tight seal which prohibits the flow of water and/or gas or other particles or contaminants from entering or exiting through the opening 14. Additionally, due to the centering arrangement of the split collars 18, 20 in relation to the cable 16, rubbing, chaffing or generally abrading of the cable 16 is eliminated in that the cable 16 is not allowed to contact any portion of the bulkhead 10, bulkhead entry enclosure 12, or the opening 14, and through the use of the foam 34 is even kept from contact with the split collars 18, 20.

Figure 5:
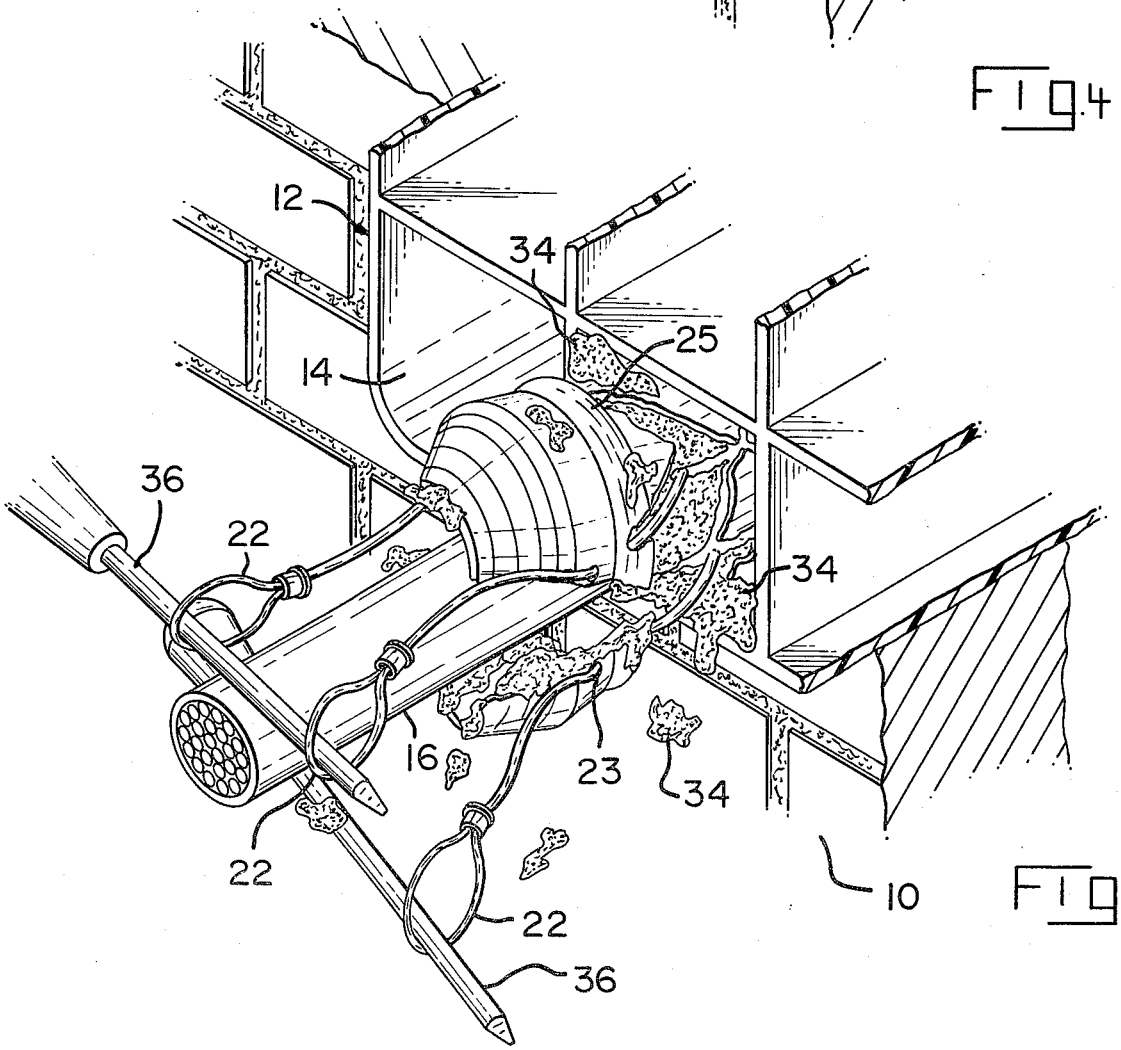
FIG. 5 is an isometric view of the present invention showing re-entry and removal of the foam and therefore the collar.

Referring now to FIG. 5 the re-enterable aspect of the present invention is illustrated. Occasionally, it is necessary to replace, remove and/or repair the cable 16. In the preferred embodiment of the present invention screw drivers 36 which are generally readily available to workers in the field are inserted into the loops at the end of the collar straps 25 either for the first portion 18 or the second portion 20 or both. By exerting a relatively modest amount of force, it can be seen how the collar strap 25 is forced to cut through the split collars 18, 20 as well as the foam 34. This, therefore allows a significant portion if not all of the collars 18, 20 as well as the foam 34 to be removed in a relatively simple and efficient manner. This therefore greatly diminishes the amount of work necessary to remove any remaining portion of the collars 18, 20 and/or the foam 34. The cable 16 may then be replaced and/or repaired as is necessary.

It is to be understood that many variations of the present invention may be utilized without departing from the spirit and scope of the present invention. For example, different opening or honeycomb arrangements may be utilized which have different shapes such as generally circular, while the entry enclosure may be entirely eliminated. Additionally, different shapes of collars may be utilized such as, for example, square or rectangular and different sizing arrangements may be utilized such as longitudinal slits. Further, different configurations for the stainless steel cable may be utilized which may, for example, use additional or less criss-crossing while the steel cable may be made of other materials such as plastic or nylon. Further, the foam entry opening may be placed in any suitable position and the collar stop may be placed elsewhere on the collars or could even allow for being forced just into the interior of the opening. Also, more exit slits as well as a series of holes or openings, while more flow ribs may also be utilized. Additionally, any suitable expandable foam may be utilized and different syringe arrangements or methods of introducing the foam into the collar may be used. Also, any suitable tool other than a screw driver or bare hands may be used to remove the steel straps whenever re-entry is desired.

Therefore, in addition to the above enumerated advantages the disclosed invention produces a re-enterable device for conduits, seal, and repair which is suitable for a multitude of cables, conduits, and/or pipes of varying sizes as well as for different bulk head entry enclosures. Additionally, the present invention provides a means for sealing conduit, pipes, and/or cables from water and/or gas which is very simple as well as inexpensive to use.

We claim:

1. A device for sealing conduit passing through an opening in a bulkhead, comprising:

a bulkhead having at least one aperture therein;

conduit means passing through said aperture in said bulkhead;

conduit sealing means disposed at a point wherein said conduit passes through said bulkhead aperture, said sealing means being comprised of a first and a second collar member, each member substantially the mirror image of the other and surrounding said conduit means, said collar members of sufficient dimension so as to form a cavity therein;

said collar means further having conduit sizing rings disposed at each end of said collars for permitting the passage of said conduit therethrough;

expandable foam entry opening contained in said first or said second collar member for permitting the introduction of an expandably expandable foam means into said cavity; and expandable foam means which when introduced into said foam entry opening in said cavity, expands thereby filling substantially all voids contained in said cavity thereby urging one or both of said collar members in substantially diametrically opposite directions, said foam means further exiting through that junction wherein said first and said second collar members meet, and substantially expanding and filling all voids between the exterior of said conduit sealing means and the bulkhead opening.

2. A device according to claim 1 wherein said expandable foam means is polyurethane.

3. A device according to claim 1 wherein said conduit is comprised of an electrical cable.

4. A device according to claim 1 wherein said conduit is comprised of a telephone cable.

5. A device according to claim 1 wherein said bulkhead is comprised of concrete.

6. A device according to claim 1 wherein said conduit sealing means and thereby said collar means are comprised of an extruded polyvinyl chloride.

7. A device according to claim 1 wherein said collar means are comprised of an injection molded polyvinyl chloride.

8. A device according to claim 1 wherein at least one foam exit slit is contained in at least one of said collar means, said foam exit slit allowing said foam means to expand therethrough.

9. A device according to claim 1 wherein a flow rib is annularly recessed into at least one of said collar means, said rib being perpendicularly disposed with respect to the longitudinal axis of said collar means, said flow rib thereby permitting said expandable foam to flow therearound so as to relatively fixedly secure said conduit sealing means to the interior portion of said opening contained in said bulkhead.

10. A device according to claim 1 wherein a cutting means passes through at least two apertures in one of said collar means for slicing through said foam means and said collar means upon pulling of said cutting means, thereby removing a portion of said foam means and said collar means so as to allow access to said conduit means.

11. A device according to claim 10 wherein cutting means is comprised of a stainless steel cable having a loop at each end thereof so as to facilitate the removal of said cutting cable means and thereby said collar means and said foam means.

12. A device according to claim 10 wherein a first cutting means is disposed in said first collar member and a second cable cutting means is disposed in said second collar member.

13. A device according to claim 12 wherein said cutting means is disposed in at least four apertures in said collar means.

14. A device according to claim 10 wherein said cutting means is disposed in at least four apertures in said collar means.

15. A device for sealing and reentering conduit passing through an opening in a bulkhead, comprising:

a bulkhead having at least one aperture therein;

conduit means passing through said aperture in said bulkhead;

conduit sealing means disposed at a point wherein said conduit passes through said bulkhead aperture, said sealing means being comprised of a first and a second collar member, each member substantially the mirror image of the other and surrounding said conduit means, said collar members of sufficient dimension so as to form a cavity therein;

said collar means further having conduit sizing rings disposed at each end of said collars for permitting the passage of said conduit therethrough;

expandable foam entry opening contained in said first or said second collar member for permitting the introduction of an expandably expandable foams means into said cavity;

expandably expandable foam means which when introduced into said foam entry opening in said cavity, expands thereby filling substantially all voids contained in said cavity thereby urging one or both of said collar members in substantially diametrically opposite directions, said foam means further exiting through that junction wherein said first and said second collar members meet, and substantially expanding and filling all voids between the exterior of said conduit sealing means and the bulkhead opening; and cutting means passing through at least two apertures in one of said collar means for slicing through said foam means and said collar means upon pulling of said cutting means, thereby removing at least a portion of said foam means and said collar means so as to allow access to said conduit means.

16. A method for sealing conduit passing through a bulkhead comprising the steps of:

a. passing conduit through an opening in a bulkhead;

b. placing a conduit seal having a top and bottom portion around the conduit creating a cavity defined by the interior wall of the seal and the exterior of the conduit contained therein;

c. positioning the conduit seal containing the conduit in the opening in the bulkhead; and d. injecting an expandable foam through an opening in the conduit seal into said cavity thereby allowing the foam to expand so as to substantially fill all the voids contained in the cavity and to thereby urge the top and bottom portions apart from each other and to further expand through a second opening in the seal so as to substantially fill all the voids existing between the exterior of the seal and the interior portion of the opening in the bulkhead.

17. A device for sealing conduit passing through an opening in a bulkhead, comprising:

a bulkhead having at least one aperture therein;

conduit means passing through said aperture in said bulkhead;

conduit sealing means disposed at a point wherein said conduit passes through said bulkhead aperture, said sealing means being comprised of a first and a second collar member, each member substantially the mirror image of the other and surrounding said conduit means, said collar members of sufficient dimension so as to form a cavity therein;

said collar means further having conduit sizing rings disposed at each end of said collars for permitting the passage of said conduit therethrough;

expandable foam entry opening contained in said first or said second collar member for permitting the introduction of an expandable foam means into said cavity;

expandable foam means which when introduced into said foam entry opening into said cavity expands thereby filling substantially all voids contained in said cavity thereby urging one or both of said collar members in substantially diametrically opposite directions, said foam means further exiting through that junction wherein said first and said second collar members meet, and substantially expanding and filling all voids between the exterior of said conduit sealing means and the bulkhead opening; and at least one flow rib is annularly recessed into at least one of said collar means, said rib being perpendicularly disposed with respect to the longitudinal axis of said collar means thereby permitting said expandable foam to flow therearound so as to relatively fixedly secure said conduit sealing means to the interior portion of said opening contained in said bulkhead.

18. A device according to claim 17 wherein a cutting means passes through at least two apertures in one of said collar means for slicing through said foam means and said collar means upon pulling of said cutting means, thereby removing a portion of said foam means and said collar means so as to allow access to said conduit means.

19. A device according to claim 18 wherein cutting means is comprised of a stainless steel cable having a loop at each end thereof so as to facilitate the removal of said cutting cable means and thereby said collar means and said foam means.

20. A device according to claim 18 wherein a first cable cutting means is disposed in said first collar member and a second cable cutting means is disposed in said second collar member.

21. A device according to claim 20 wherein said cable cutting means is disposed in at least four apertures in said collar means.

22. A device according to claim 18 wherein said cable cutting means is disposed in at least four apertures in said collar means.

* * * * *